US005582761A

United States Patent [19]

Bloch et al.

[11] Patent Number: 5,582,761

[45] Date of Patent: Dec. 10, 1996

[54] INCREASING THE FRICTION DURABILITY OF POWER TRANSMISSION FLUIDS THROUGH THE USE OF OIL SOLUBLE COMPETING ADDITIVES

[75] Inventors: Ricardo A. Bloch, Scotch Plains; Roger K. Nibert, Hampton; Jack Ryer, East Brunswick; Raymond F. Watts, Long Valley, all of N.J.

[73] Assignee: Exxon Chemical Patents Inc., Linden, N.J.

[21] Appl. No.: 561,220

[22] Filed: Nov. 21, 1995

Related U.S. Application Data

[60] Continuation of Ser. No. 454,046, May 30, 1995, abandoned, which is a division of Ser. No. 170,570, Dec. 20, 1993.

[51] Int. Cl.[6] ..... C10M 133/14

[52] U.S. Cl. ..... 508/307; 508/404; 508/428; 508/513; 508/551; 508/562

[58] Field of Search ..... 252/51.5 A, 51.5 R

[56] References Cited

U.S. PATENT DOCUMENTS

| | | | |
|---|---|---|---|
| 3,186,946 | 6/1965 | Sluhan | 252/49.3 |
| 3,711,406 | 1/1973 | Lowe | 252/33.4 |
| 3,809,651 | 5/1974 | Crawford et al. | 252/47.5 |
| 3,873,460 | 3/1975 | Coon et al. | 252/51.5 A |
| 3,879,306 | 4/1975 | Kablaoui et al. | 252/51.5 A |
| 3,972,243 | 8/1976 | Driscoll et al. | 74/200 |
| 4,094,800 | 6/1978 | Warne | 252/32.7 E |
| 4,101,429 | 7/1978 | Birke | 252/32.7 E |
| 4,170,560 | 10/1979 | Lowe | 252/47.5 |
| 4,231,883 | 11/1980 | Malec | 252/33.4 |
| 4,253,977 | 3/1981 | O'Halloran | 252/33.4 |
| 4,256,595 | 3/1981 | Sung et al. | 252/51.5 A |
| 4,409,000 | 10/1983 | Le Suer | 252/51.5 R |
| 4,563,293 | 1/1986 | Small, Jr. | 252/32.7 E |
| 4,629,576 | 12/1986 | Small, Jr. | 252/32.7 E |
| 4,663,063 | 5/1987 | Davis | 252/51.5 R |
| 4,755,311 | 7/1988 | Burjes et al. | 252/49.9 |
| 4,772,739 | 9/1988 | Forsberg | 558/208 |
| 4,792,410 | 12/1988 | Schwind et al. | 252/38 |
| 4,971,598 | 11/1990 | Andress et al. | 44/57 |
| 4,973,789 | 11/1990 | Karn et al. | 585/525 |
| 5,176,840 | 1/1993 | Campbell et al. | 252/51.5 A |
| 5,190,680 | 3/1993 | Bullen et al. | 252/51.5 A |
| 5,290,463 | 3/1994 | Habeeb | 252/51.5 A |
| 5,330,667 | 7/1994 | Tiftany, III et al. | 252/51.5 A |
| 5,339,855 | 8/1994 | Hellsten et al. | 252/51.5 A |

FOREIGN PATENT DOCUMENTS

| | | | |
|---|---|---|---|
| 0305538A1 | 2/1988 | European Pat. Off. | C10M 141/02 |
| 0389237A3 | 9/1990 | European Pat. Off. | C10M 133/16 |
| 0393769A1 | 10/1990 | European Pat. Off. . | |
| 0407124A1 | 1/1991 | European Pat. Off. | C10M 141/10 |
| 0448207A1 | 9/1991 | European Pat. Off. | C10M 133/00 |
| 0544298A1 | 6/1993 | European Pat. Off. | C10M 163/00 |
| 1087039 | 10/1967 | United Kingdom . | |
| WO87/07637 | 12/1987 | WIPO . | |

*Primary Examiner*—Jacqueline V. Howard
*Attorney, Agent, or Firm*—T. J. Shatynski

[57] ABSTRACT

A method of controlling the friction coefficients and improving the friction durability of an oleaginous compositions, such as an ATF, comprising adding to the composition a combination of competing additives comprising (1) at least one friction modifying chemical additive having a polar head group and a friction reducing substituent group and (2) at least one non-friction reducing additive and/or friction increasing additive having the same polar group as the friction modifying chemical additive, but having a substituent group which has no material friction raising or lowering effect (non-friction reducing additive) or a substituent group which increases the friction coefficients (friction increasing additive) of the composition.

9 Claims, 2 Drawing Sheets

INCREASING THE FRICTION DURABILITY OF POWER TRANSMISSION FLUIDS THROUGH THE USE OF OIL SOLUBLE COMPETING ADDITIVES

This is a continuation of application Ser. No. 08/454,046, filed May 30, 1995, now abandonded, which is a Rule 60 Divisional of U.S. Ser. No. 08/170,570, filed Dec. 20, 1993.

BACKGROUND OF THE INVENTION

1. Field of the Invintion

The present invention relates to a method of and compositions for improving the friction durability of power transmission fluids.

2. Description of Related Art

Power transmission fluids, such as automatic transmission fluids, are formulated to very exacting friction requirements set by original equipment manufacturers. These requirements have two primary aspects, namely: (1) the absolute level of the friction coefficients, i.e., static friction, $\mu_s$, and dynamic friction, $\mu_d$, that can be achieved by these fluids, and (2) the length of time that these fluids can be used without undergoing an appreciable change in the friction coefficients. This latter performance feature is also known as friction durability.

Since friction durability is a function of the type and concentration of friction modifier molecules present in a given fluid, such as a power transmission fluid, conventionally there are only limited ways of improving friction durability. One of these ways is to add more friction modifier, i.e., to increase the concentration of friction modifier in the fluid. Since friction modifiers are consumed at a somewhat fixed rate, this will prolong the effective life of the fluid. However, this approach often is not very practical because increasing the concentration of the friction modifier usually will result in a lowering of the absolute values of the friction coefficients to a point where they are below the minimum values specified by the original equipment manufacturer. Then, as the friction modifier is consumed with time, the friction coefficients will slowly rise to unacceptable levels. The other conventional approach for improving friction durability is to find more stable friction modifiers. This is not always easy since most friction modifiers are simple organic chemicals and are subject to oxidation and chemical reactions during service.

Various compositions and methods have been suggested for modifying the properties of oleaginous fluids. For example, U.S. Pat. No. 4,253,977 relates to an ATF composition which comprises a friction modifier such as n-octadecyl succinic acid or the reaction product of an alkyl or alkenyl succinic anhydride with an aldehyde/tris hydroxymethyl aminomethane adduct and an overbased alkali or alkaline earth metal detergent. The ATF may also contain a conventional hydrocarbyl-substituted succinimide ashless dispersant such as polyisobutenyl succinimide. Other patents which disclose ATF compositions that include conventional alkenyl succinimide dispersants include, for example, U.S. Pat. Nos. 3,879,306; 3,920,562; 3,933,659; 4,010,106; 4,136,043; 4,153,567; 4,159,956; 4,596,663 and 4,857,217; British Patents 1,087,039; 1,474,048 and 2,094,339; European Patent Application 0,208,541(A2); and PCT Application WO 87/07637.

U.S. Pat. No. 3,972,243 discloses traction drive fluids which comprise gem-structured polyisobutylene oligomers. Polar derivatives of such gem-structured polyisobutylenes can be obtained by conversion of the polyisobutylene oligomers to polar compounds containing such functional groups as amine, imine, thioketone, amide, ether, oxime, maleic anhydride, etc. adducts. The polyisobutylene oligomers generally contain from about 16 to about 48 carbon atoms. Example 18 of this patent discloses reacting a polyisobutylene oil with maleic anhydride to form a polyisobutylene succinic anhydride which is useful as a detergent, as an anti-wear agent, and as an intermediate in the production of a hydrazide derivative. Other patents containing similar disclosures include, for example, U.S. Pat. No. 3,972,941; U.S. Pat. No. 3,793,203; U.S. Pat. No. 3,778,487 and U.S. Pat. No. 3,775,503.

While the prior art suggests a variety of additives for modifying the properties of various oleaginous compositions, there is no suggestion of any additives, nor of any combination of additives, which can simultaneously control the friction coefficients and friction durability of such compositions. Accordingly, there is a continuing need for new additives, as well as new methods, which would enable the formulation of oleaginous compositions, including lubricating oils and power transmission fluids, having specifically controlled friction coefficients and improved friction durability.

SUMMARY OF THE INVENTION

In one embodiment, this invention relates to a method of improving the friction durability of an oleaginous composition, which comprises: adding to a major portion of an oil of lubricating viscosity a friction durability improving effective amount of an oil soluble combination of chemical additives comprising (a) a first chemical additive comprising a polar head group and a friction reducing substituent group, and (b) at least one other chemical additive having the same polar head group as said first chemical additive but having a substituent group selected from non-friction reducing substituent groups and friction increasing substituent groups.

In another embodiment, this invention relates to compositions which comprise a combination of at least two chemical additives having the same polar head group, wherein at least one of the chemical additives contains a friction modifying, i.e., friction reducing, substituent group, and at least one other of the chemical additives contains either a non-friction reducing substituent group or a friction increasing substituent group.

DETAILED DESCRIPTION OF THE INVENTION

Figure 1:
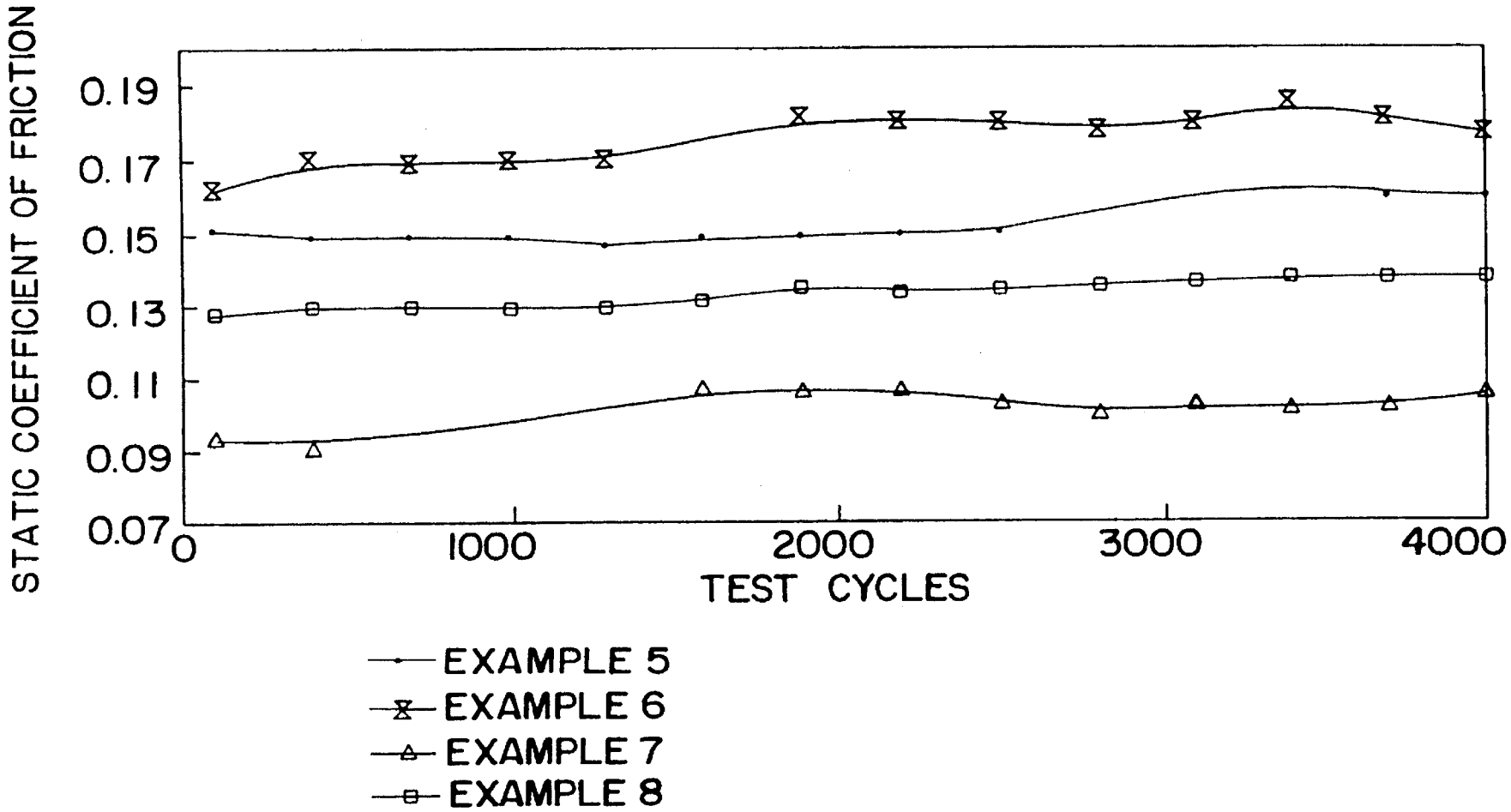
FIG. 1 is a graph illustrating the static coefficient of friction versus the number of test cycles using an SAE No. 2 Friction Test Machine run to 4,000 engagement cycles using the test specified by Ford Motor Company in the MERCON® specification.

A primary advantage of the present invention is that it enables the fluid formulator to increase the concentration of the active friction reducer without reducing the absolute values of the friction coefficients to a point below the minimum specified by the original equipment manufacturer. This is accomplished by placing in the oleaginous composition, such as an automatic transmission fluid, a friction reducing chemical additive and a non-friction reducing chemical additive (or friction increasing chemical additive) of the same chemical species. For example, an ethoxylated $C_{18}$ amine friction reducer can be added to an automatic transmission fluid along with an ethoxylated $C_4$ amine non-friction reducing additive; or a long chain carboxylic acid, such as oleic acid or isostearic acid, can be added as a friction reducing additive and a shorter chain carboxylic acid, such as hexanoic acid, can be added as a non-friction reducing additive; or a linear hydrocarbyl substituted amide, such as the reaction product of isostearic acid and tetraethylene pentamine (TEPA) can be added as a friction reducing additive, and a branched chain hydrocarbyl substituted amide, such as the reaction product of polyisobutenyl succinic acid and TEPA (wherein the polyisobutenyl moiety has a number average molecular weight of about 450), can be added as a friction increasing additive.

While not wishing to be bound to a particular theory, it is believed that once in the fluid, the two chemical additives compete substantially equally for the surfaces which are contacted since they have similar adsorption characteristics. Accordingly, not all of the friction reducing additive will contact the surfaces even if there is an excess of friction reducer in the fluid. This enables the formulator to intentionally add more friction reducing additive to the fluid than could normally be tolerated without lowering the friction coefficients to a level below the minimum specified by the original equipment manufacturer. Then, as the additives which are in contact with the surfaces are slowly consumed, an additional portion of the excess friction reducer and non-friction reducer originally present in the fluid can come in contact with the surfaces, thereby maintaining the friction coefficients at the desired levels. Since the friction reducing chemical additive and the non-friction reducing and/or friction increasing chemical additives are consumed at relatively equal rates, the friction coefficients of the resulting fluid will remain essentially constant over a long period of use, i.e., the fluid will exhibit a substantially improved friction durability relative to fluids containing only a friction reducing chemical additive or a non-friction reducing additive or a friction increasing chemical additive.

The oil soluble friction reducing additives contemplated for use in this invention comprise any of those chemical additives conventionally employed for reducing the friction coefficients of oleaginous fluids to which they are added. Typically, such friction reducing additives comprise a polar head group and a friction reducing substituent group which is linked to the polar head group.

The friction reducing substituent group normally would comprise a substantially linear hydrocarbyl group having at least about 10 carbon atoms, typically from about 10 to about 30 carbon atoms, and preferably from about 14 to about 18 carbon atoms. Examples of such linear hydrocarbyl groups include, but are not limited to oleyl, isostearyl and octadecenyl groups.

The polar head groups which are contemplated for use in the present invention vary widely and any polar group which is conventionally present in a friction reducing additive may be employed. Typically, however, the polar head groups present in the friction reducing (and in the non-friction reducing and friction increasing) additives contemplated for use in this invention include, for example, polar head groups having the following moieties:

$-N(CH_2CH_2OH)_2$, $-COOH$, $-CONH_2$, $-CONH-(CH_2CH_2NH)_xC(O)R$,

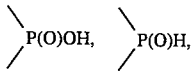

$-P(OR)_2$,

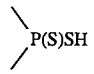

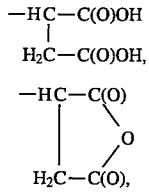

$-SH$, $-SO_2H$, and $-SO_3H$ wherein R represents a $C_1$ to $C_{30}$ linear or branched hydrocarbyl group and x represents an integer of from 1 to about 8.

As indicated above, the polar head group may vary widely. However, in preferred aspects of the invention,the polar head group typically comprises the residue of an amine compound, i.e., polar group precursor, containing at least 2, typically 2 to 60, and preferably 2 to 40 total carbon atoms, and at least 1, typically 2 to 15, and preferably 2 to 9 nitrogen atoms, with at least one nitrogen atom preferably being present in a primary or secondary amine group. The amine compounds may be hydrocarbyl amines or may be hydrocarbyl amines including other groups, e.g., hydroxy groups, alkoxy groups, amide groups, nitrile groups, imidazole groups, morpholine groups or the like. The amine compounds also may contain 1 or more boron or sulfur atoms, provided that such atoms do not interfere with the substantially polar nature and function of the selected polyamine.

Useful amines include those of the formulas I and II:

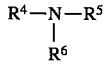

(I)

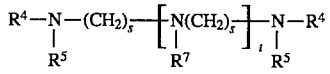

II)

wherein $R^4$ ,$R^5$ ,$R^6$ and $R^7$ are independently selected from the group consisting of hydrogen, $C_1$ to $C_{25}$ linear or branched alkyl radicals, $C_1$ to $C_{12}$ alkoxy $C_2$ to $C_6$ alkylene radicals, $C_2$ to $C_{12}$ hydroxy amino alkylene radicals, and $C_1$ to $C_{12}$ alkylamino $C_2$ to $C_6$ alkylene radicals; and wherein $R^7$ can additionally comprise a moiety of the formula:

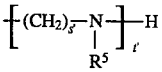

wherein $R^5$ is defined above; wherein s and s' can be the same or a different number of from 2 to 6, preferably 2 to 4;

and t and t' can be the same or a different number of from 0 to 10, preferably 0 to 7 with the proviso that the sum of t and t' is not greater than 15.

Non-limiting examples of suitable amine compounds include: 1,2-diaminoethane, 1,6-diaminohexane; polyethylene amines such as tetraethylene pentamine; polypropylene amines such as 1,2-propylene diamine; di-(1,2-propylene diamine; di-(1,2-propylene)triamine; di-(1,3-propylene) triamine; N,N-dimethyl-1,3-diaminopropane; N,N-di(2aminoethyl) ethylene diamine; N,N-di(2hydroxyethyl)1, 3-propylene diamine; 3-dodecyloxy-propylamine, N-dodecyl-1,3-propane diamine, etc.

Other suitable amines include: amino morpholines such as N-(3-aminopropyl) morpholine and N-(2-aminoethyl) morpholine; substituted pyridines such as 2-amino pyridine, 2-methylamino pyridine and 2-methylamino pyridine; and others such as 2-aminothiazole; 2-amino pyrimidine; 2-amino benzothiazole; methyl-1-phenyl hydrazine and paramorpholino aniline, etc. A preferred group of aminomorpholines are those of the formula III:

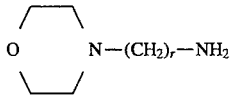

(III)

where r is a number having a value of 1 to 5.

Useful amines also include alicyclic diamines, imidazolines and N-aminoalkyl piperazines of the formula IV:

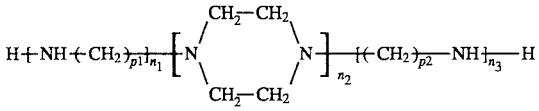

(IV)

wherein $p_1$ and $p_2$ are the same or different and each is an integer of from 1 to 4; and $n_1$, $n_2$ and $n_3$ are the same or different and each is an integer from 1 to 3.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and corresponding piperazines. Low cost poly(ethyleneamine) compounds averaging about 5 to 7 nitrogen atoms per molecule are available commercially under trade names such as "Polyamine H", "Polyamine 400", "Dow Polyamine E-100", etc.

Useful amines also include polyoxyalkylene polyamines such as those having the formula V:

$$NH_2\text{-alkylene -(O-alkylene)}_m\ NH_2, \quad \text{(V)}$$

wherein m has a value of at least 3 and "alkylene" represents a linear or branched chain $C_2$ to $C_7$, preferably $C_2$ to $C_4$ alkylene radical; or the formula VI:

$$R^6\text{-(alkylene-(O-alkylene)}_{m'\text{-}NH2}\ )_a, \quad \text{(VI)}$$

wherein $R^8$ is a polyvalent saturated hydrocarbon radical having up to 10 carbon atoms and the number of substituents on the $R^8$ group is represented by the value of "a", which is a number of from 3 to 6, wherein m' has a value of at least 1; and wherein "alkylene" represents a linear or branched chain $C_2$ to $C_7$, preferably $C_2$ to $C_4$ alkylene radical.

The polyoxyalkylene polyamines of formulas (V) or (VI) above, preferably polyoxyalkylene diamines and polyoxyalkylene triamines, may have average molecular weights ranging from about 200 to about 4000 and preferably from about 400 to about 2000. The preferred polyoxyalkylene polyamines include the polyoxyethylene and polyoxypropylene polyamines. The polyoxyalkylene polyamines are commercially available and may be obtained, for example, from the Jefferson Chemical Company, Inc. under the trade name "Jeffamines D-230, D-400, D-1000, D-2000, T-403", etc.

The polar group may be joined to the linking group through an ester linkage when the linking group is a carboxylic acid or anhydride. To incorporate polar groups of this type, they must have a free hydroxyl group and all of the nitrogen atoms in the polar group must be tertiary nitrogen atoms. Polar groups of this type are represented by formula VII:

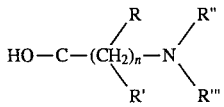

(VII)

wherein n has a value of from 1 to 10, R and R' are H or $C_1$ to $C_{12}$ alkyl, and R" and R'" are $C_1$ to $C_6$ alkyl.

Forming the Friction Reducers

In accordance with one aspect of the invention, the friction reducing additives may be prepared by reacting a long chain linear carboxylic acid or anyhydride with a polar group precursor, preferably a nitrogen-containing polar group precursor, such as tetraethylene pentamine or diethylene triamine, to form the corresponding long linear hydrocarbyl amide.

Representative examples of suitable long chain linear carboxylic acid reactants include, for example, nonanoic (pelargonic); decanoic (capric); undecanoic; dodecanoic (lauric); tridecanoic; tetradecanoic (myristic); pentadecanoic; hexadecanoic (palmitic); heptadecanoic (margaric); octadecanoic (stearic), (isostearic); nonadecanoic; eicosanoic (arachidic); docosanoic (behenic); tetracosanoic (lignoceric); hexacosanoic (cerotic); octacosanoic (monanic); triacontanoic (melissic); nonenoic; docenoic; undecenoic; dodecenoic; tridecenoic; pentadecenoic; hexadecenoic; heptadecenoic; octadecenoic (e.g., oleic); cicosenoic; tetracosenoic 12-hydroxystearic; ricinoleic; and mixtures thereof. Also included among the suitable carboxylic acid reactants are long chain anhydrides such as octadecenyl succinic anhydride.

The preferred long chain carboxylic acid reactants are oleic acid, stearic acid, isotearic acid, octadecenyl succinic anhydride, as well as mixtures of stearic and isostearic acids (e.g., a weight ratio of stearic to isostearic of from about 1:0.8 to about 1:9 preferably 1:5).

Typically, from about 5 to about 0.5, preferably from about 3 to about 1, and most preferably from about 1.5 to about 1 moles of said carboxylic acid reactant are charged to the reactor per mole of primary nitrogen contained in the polar group precursor. The long chain linear carboxylic acid reactant may be readily reacted with a polar group precursor, i.e. amine compound, by heating at a temperature of from about 100° C. to 250° C., preferably from 120° C. to 230° C., for a period of from about 0.5 to 10 hours, usually about 1 to about 6 hours.

Alternatively, the polyamine polar group may be reacted with an aldehyde and a hydrocarbyl substituted aromatic compound in a conventional manner to form Mannich condensates having friction reducing properties.

In another aspect of the invention, the friction reducing additive may comprise an alkoxylated amine. These types of friction reducing additives typically would be selected from compounds having the formula (VIII) or (IX), and mixtures thereof, where (VIII) and (IX) are:

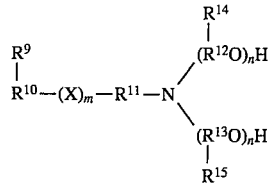

(VIII)

and

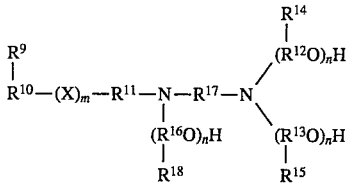

(IX)

where:

$R^9$ is H or $CH_3$;

$R^{10}$ is a $C_8$–$C_{28}$ saturated or unsaturated, substituted or unsubstituted, aliphatic hyrocarbyl radical, preferably $C_{10}$–$C_{20}$, most preferably $C_{14}$–$C_{18}$;

$R^{11}$ is a straight or branched chain $C_1$–$C_6$ alkylene radical, preferably $C_2$–$C_3$;

$R^{12}$, $R^{13}$ and $R^{16}$ are independently the same or different, straight or branched chain $C_2$–$C_5$ alkylene radical, preferably $C_2$–$C_4$;

$R^{14}$, $R^{15}$, and $R^{18}$ are independently H or $CH_3$;

$R^{17}$ is a straight or branched chain $C_1$–$C_5$ alkylene radical, preferably $C_2$–$C_3$;

X is oxygen or sulfur, preferably oxygen; m is 0 or 1, preferably 1; and n is an integer, independently 1–4, preferably 1.

In a particularly preferred embodiment, this type of friction reducing additive is characterized by formula (VIII) where X represents oxygen, $R^9$ and $R^{10}$ contain a combined total of 14 carbon atoms, $R^{11}$ represents a $C_3$ alkylene radical, $R^{12}$ and $R^{13}$ represent $C_2$ alkylene radicals, $R^{14}$ and $R^{15}$ are hydrogens, m is 1, and each n is 1. Preferred amine compounds contain a combined total of from about 18 to about 34 carbon atoms.

Preparation of the amine compounds, when X is oxygen and m is 1, is, for example, by a multi-step process where an alkanol is first reacted, in the presence of a catalyst, with an unsaturated nitrile such as acrylonitrile to form an ether nitrile intermediate. The intermediate is then hydrogenated, preferrably in the presence of a conventional hydrogenation catalyst, such as platinum black or Raney nickel, to form an ether amine. The ether amine is then reacted with an alkylene oxide, such as ethylene oxide, in the presence of an alkaline catalyst by a conventional method at a temperature in the range of about 90°–150° C.

Another method of preparing the amine compounds, when X is oxygen and m is 1, is to react a fatty acid with ammonia or an alkanol amine, such as ethanolamine, to form an intermediate which can be further alkoxylated by reaction with an alkylene oxide, such as ethylene oxide or propylene oxide. A process of this type is discussed in, for example, U.S. Pat. No. 4,201,684, the disclosure of which is incorporated herein by reference.

When X is sulfur and m is 1, the amine friction reducing additives can be formed, for example, by effecting a conventional free radical reaction between a long chain alpha-olefin with a hydroxyalkyl mercaptan, such as beta-hydroxyethyl mercaptan, to produce a long chain alkyl hydroxyalkyl sulfide. The long chain alkyl hydroxyalkyl sulfide is then mixed with thionyl chloride at a low temperature and then heated to about 40° C. to form a long chain alkyl chloroalkyl sulfide. The long chain alkyl chloroalkyl sulfide is then caused to react with a dialkanolamine, such as diethanolamine, and, if desired, with an alkylene oxide, such as ethylene oxide, in the presence of an alkaline catalyst and at a temperature near 100° C. to form the desired amine compounds. Processes of this type are known in the art and are discussed in, for example, U.S. Pat. No. 3,705,139, the disclosure of which is incorporated herein by reference.

In cases when X is oxygen and m is 1, the present alkoxylated amine friction reducers are well known in the art and are described in, for example, U.S. Pat. No. 3,186,946; 4,170,560; 4,231,883; 4,409,000; and 3,711,406, the disclosures of these patents being incorporated herein by reference.

Examples of suitable alkoxylated amine compounds include, but are not limited to, the following:

N,N-bis(2-hydroxyethyl)-n-dodecylamine;
N,N-bis(2-hydroxyethyl)-1-methyl-tridecenylamine;
N,N-bis(2-hydroxyethyl)-hexadecylamine;
N,N-bis(2-hydroxyethyl)-octadecylamine;
N,N-bis(2-hydroxyethyl)-octadecenylamine;
N,N-bis(2-hydroxyethyl)-oleylamine;
N,N-bis(2-hydroxyethyl)-stearylamine;
N,N-bis(2-hydroxyethyl)-undecylamine;
N-(2-hydroxyethyl)-N-(hydroxyethoxyethyl)-n-dodecylamine;
N,N-bis(2-hydroxyethyl)-1-methyl-undecylamine;
N,N-bis(2-hydroxyethoxyethoxethyl)-1-ethyloctadecylamine;
N,N-bis(2-hydroxyethyl)-cocoamine;
N,N-bis(2-hydroxyethyl)-tallowamine;
N,N-bis(2-hydroxyethyl)-n-dodecycloxyethylamine;
N,N-bis(2-hydroxyethyl)-lauryloxyethylamine;
N,N-bis(2-hydroxyethyl)-stearyloxyethylamine;
N,N-bis(2-hydroxyethyl)-dodecylthioethylamine;
N,N-bis(2-hydroxyethyl)-dodecylthiopropylamine;
N,N-bis(2-hydroxyethyl)-hexadecyloxypropylamine;
N,N-bis(2-hydroxyethyl)-hexadecylthiopropylamine;
N-2-hydroxyethyl,N-[N',N'-bis(2-hydroxyethyl) ethylamine]-octadecylamine; and
N-2-hydroxyethyl,N-[N',N'-bis(2-hydroxyethyl) ethylamine]-stearylamine.

The Non-friction Reducing and Friction Increasing Additives

The oil soluble non-friction reducing additives and the oil soluble friction increasing additives correspond generally to the above-described friction reducing additives, except that the friction reducing substituent group is replaced with a substituent that either increases or has no material effect on the friction coefficients of the fluids to which the non-friction reducing and/or friction increasing additives are added.

Typically, for non-friction reducing additives, the long chain, linear hydrocarbyl substituent group which is present in the friction reducing additives would be replaced with a shorter chain linear or branched hydrocarbyl substituent group, e.g., one having a chain length of less than about 10 carbon atoms. Thus, hydrocarbyl groups such as butyl, hexyl or octyl would be typical of those hydrocarbyl groups that would be present in the non-friction reducing additives contemplated for use in this invention.

Representative examples of chemical additives which would be useful as the non-friction reducing additive include, but are not limited to diethoxylated butylamine, diethoxylated hexylamine, hexanoic tetraethylene pentamine diamide and octanoic triethylene tetramine diamide.

For the friction increasing additives, the long chain, linear hydrocarbyl substituent group A of formula I would be replaced by a branched hydrocarbyl group typically containing from about 12 to about 50 carbon atoms and having a molecular weight on the order of from about 150 to about 700. In preferred embodiments, however, the molecular weight of the hydrocarbyl group ranges from about 350 to about 600, and most preferably from about 400 to about 500.

Suitable branched hydrocarbyl groups include alkyl, alkenyl, aryl, cycloalkyl groups, and hetero atom-containing analogs thereof.

As the case for the linear hydrocarbyl group A of the above-described friction reducing additives, the branched hydrocarbyl group of the friction increasing additives may contain one or more hetero atoms, e.g., nitrogen, oxygen, phosphorus, and sulfur. Preferred hetero atoms are sulfur and oxygen.

In one preferred embodiment, the hydrocarbyl group present in the friction increasing additives may be represented by the formula X:

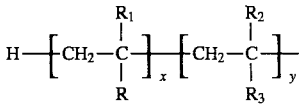

(X)

wherein R represents a linear or branched $C_1$ to $C_{12}$ hydrocarbyl group, such as an alkyl, alkenyl, aryl alkaryl, aralkyl or cycloalkyl group or hetero-containing analog thereof; wherein $R_1$, $R_2$ and $R_3$, which can be the same or different, independently represent H or a linear or branch $C_1$ to $C_{12}$ hydrocarbyl group, as defined above; x represents an integer from 1 to about 17; and y represents zero or an integer of from 1 to about 10; and wherein the total number of carbon atoms in the branched hydrocarbyl group is from about 12 to about 50, typical from about 25 to about 45, and preferably from about 28 to about 36.

A preferred branched hydrocarbyl group is branched alkenyl, preferably derived from an olefin polymer. The olefin polymer may comprise a homopolymer of an olefin monomer having 3 to about 12, preferably 3 to 6, carbon atoms, or a copolymer of olefin monomers containing 2 to about 12, preferably 2 to 6, carbon atoms. Suitable copolymers include random, block and tapered copolymers, provided that such copolymers possess a branched structure.

Suitable monomers include, for example, ethylene, propylene, isobutylene, pentene, 2-methyl pentene, hexene, 2-ethyl hexene, and diolefins such as butadiene and isoprene, provided that the resulting homopolymers or copolymer are branched. While selection of monomers suitable for preparing branched homopolymers or copolymers is readily apparent to those skilled in the art, it is preferred to use a branched hydrocarbyl group derived from propylene, for example, tetrapropylene, or from isobutylene, for example, polyisobutylene having a number average molecular weight of from about 150 to about 700, preferably from about 350 to about 600, and most preferably from about 400 to about 500.

The linking group which may be reacted with the branched hydrocarbyl group and with the polar group typically to form the friction increasing additives contemplated for use in this invention may be derived from a monounsaturated carboxylic reactant as outlined above in connection with the friction modifier additives.

Exemplary of such monounsaturated carboxylic reactants are fumaric acid, itaconic acid, itaconic anhydride, maleic acid, maleic anhydride, chloromaleic acid, chloromaleic anhydride, acrylic acid, methacrylic acid, crotonic acid, hemic anhydride, cinnamic acid, and lower alkyl (e.g., $C_1$ to $C_4$ alkyl) acid esters of the foregoing, e.g., methyl maleate, ethyl fumarate, methyl fumarate, etc.

Maleic anhydride or a derivative thereof is preferred as it does not homopolymerize appreciably, but attaches onto the branched hydrocarbyl group to give two carboxylic acid functionalities. In addition to unsaturated carboxylic acid materials described, the linking group may comprise the residue of a functionalities aromatic compound, such as a phenol or a benzene sulfonic acid, as described above in connection with the friction modifier additives.

In such cases, the friction increasing additives may be prepared, for example, by a conventional Mannich Base condensation of aldehyde, (e.g., formaldehyde), polar group precursor (e.g. alkylene polyamine) and branched hydrocarbyl group substituted phenol as described above in connection with the friction modifier additives contemplated for use herein.

Sulfur-containing Mannich condensates also may be used. Generally, the condensates useful in this invention are those made from a phenol having a branched hydrocarbyl substituent of about 14 to about 50 carbon atoms, more typically, 25 to about 45 carbon atoms. Typically these condensates are made from formaldehyde or a $C_2$ to $C_7$ aliphatic aldehyde and an amino compound.

These Mannich condensates may be prepared in the manner discussed above in connection with the friction reducing additives contemplated for use herein.

The polar group of the friction increasing additives preferably comprises the residue of an amine compound, i.e. polar group precursor, containing at least 2, typically 2 to 60, and preferably 2 to 40 total carbon atoms, and at least 2, typically 2 to 15, and preferably 2 to 9 nitrogen atoms, with at least one nitrogen atom being present in a primary or secondary amine group. The amine compounds may be hydrocarbyl amines or may be hydrocarbyl amines including other groups, e.g., hydroxy groups, alkoxy groups, amide groups, nitrile groups, imidazole groups, morpholine groups or the like. The amine compounds also may contain 1 or more boron or sulfur atoms, provided that such atoms do not interfere with the substantially polar nature and function of the selected polyamine.

Useful amines include those described above in connection with the friction reducers contemplated for use herein.

In accordance with one aspect of the invention, the branched hydrocarbyl group precursor (e.g., 450 $M_n$ polyisobutylene) may be reacted with or grafted to the linking group precursor (e.g. monounsaturated carboxylic reactant), preferably in solution in a diluent oil.

Typically, from about 0.7 to about 4.0 (e.g., 0.8 to 2.6), preferably from about 1.0 to about 2.0, and most preferably from about 1.1 to about 1.7 moles of said monounsaturated carboxylic reactant are charged to the reactor per mole of branched hydrocarbyl group precursor.

Normally, not all of the hydrocarbyl group precursor reacts with the monounsaturated carboxylic reactant and the reaction mixture will contain unreacted hydrocarbyl material. The unreacted hydrocarbyl material is typically not removed from the reaction mixture (because such removal is difficult and would be commercially infeasible) and the product mixture, stripped of any monounsaturated carboxylic reactant is employed for further reaction with the polar group precursor as described hereinafter to make the friction increaser.

Characterization of the average number of moles of monounsaturated carboxylic reactant which have reacted per mole of hydrocarbyl material changed to the reaction (whether it has undergone reaction or not) is defined herein as functionality. Said functionality is based upon (i) determination of the saponification number of the resulting product mixture using potassium hydroxide; and (ii) the number average molecular weight of the polymer charged, using techniques well known in the art. Functionality is defined solely with reference to the resulting product mixture. Although the amount of the reacted hydrocarbyl material contained in the resulting product mixture can be subsequently modified, i.e., increased or decreased by techniques known in the art, such modifications do not alter functionality as defined above.

Typically, the functionality of the branched hydrocarbyl substituted mono- and dicarboxylic acid material is at least about 0.5, preferably at least about 0.8, and most preferably at least about 0.9 and will vary typically from about 0.5 to about 2.8 (e.g., 0.6 to 2), preferably from about 0.8 to about 1.4 and most preferably from about 0.9 to about 1.3.

The branched hydrocarbyl reactant can be reacted with the monounsaturated carboxylic reactant by a variety of methods. For example, the hydrocarbyl reactant can be first halogenated, e.g., chlorinated or brominated, to about 1 to 8 wt. % preferably 3 to 7 wt. % chlorine, or bromine, based on the weight of hydrocarbyl reactant, by passing the chlorine or bromine through the hydrocarbyl reactant at a temperature of 60° to 150° C., preferably 110° to 160° C., e.g. 120° C., for about 0.5 to 10, preferably 1 to 7 hours. The halogenated hydrocarbyl reactant may then be reacted with sufficient monounsaturated carboxylic reactant at 100° to 150° C., usually about 180° to 235° C., for about 0.5 to 10, e.g. 3 to 8 hours, so the product obtained will contain the desired number of moles of the monounsaturated carboxylic reactant per mole of the halogenated hydrocarbyl reactant. Processes of this general type are taught in U.S. Pat. Nos. 3,087,436; 3,172,892; 3,272,746 and others. Alternatively, the hydrocarbyl reactant and the monounsaturated carboxylic reactant may be mixed and heated while adding chlorine to the hot material. Processes of this type are disclosed in U.S. Pat. Nos. 3,215,707; 3,231,587; 3,912,764; 4,110,349; 4,234,435; and in U.K. 1,440,219.

Alternatively, the hydrocarbyl group may be grafted onto the monounsaturated carboxylic reactant using free radical initiators such as peroxides and hydroperoxides, preferably those which have a boiling point greater than about 100° C. and which decompose thermally within the grafting temperature range to provide said free radicals. Representative of these free-radical initiators are azobutyronitrile, 2,5-dimethyl-hex-3-yne-2,5-bis-tertiary-butyl peroxide (sold as Lupersol 130) or its hexane analogue, ditertiary butyl peroxide and dicumyl peroxide. The initiator is generally used at a level of between about 0.005% and about 1%, based on the total weight of the reaction mixture, and at a temperature of about 25° to 220° C., preferably 150°–200° C.

The unsaturated carboxylic acid material, preferably maleic anhydride, generally will be used in an amount ranging from about 0.05% to about 10%, preferably 0.1 to 2.0%, based on weight of the reaction mixture. The carboxylic acid material and free radical initiator generally are used in a weight percent ratio range of 3.0:1 to 30.1; preferably 1.0:1 to 6.0:1.

The initiator grafting preferably is carried out in an inert atmosphere, such as that obtained by nitrogen blanketing. While the grafting can be carried out in the presence of air, the yield of the desired grafted product is generally thereby decreased as compared to grafting under an inert atmosphere substantially free of oxygen. The grafting time usually will range from about 0.05 to 12 hours, preferably from about 0.1 to 6 hours, more preferably 0.5 to 3 hours. The graft reaction usually will be carried out to at least approximately 4 times, preferably at least about 6 times the half life of the free-radical initiator at the reaction temperature employed, e.g. with 2,5-dimethyl-hex-3-yne-2,5-bis (t-butyl peroxide) 2 hours at 160° C. and one hour 170° C., etc.

In the grafting process, usually the hydrocarbyl material to be grafted, is dissolved in the liquid synthetic oil (normally liquid at about 21° C.) by heating to form a solution and thereafter the unsaturated carboxylic acid material and initiator are added with agitation, although they could have been added prior to heating. When the reaction is complete, the excess acid may be eliminated by an inert gas purge, e.g., nitrogen sparging. Preferably any carboxylic acid material that is added is kept below its solubility limit. For example, maleic anhydride is kept below about 1 wt. %, preferably below 0.4 wt. % or less, of free maleic anhydride based on the total weight of solution. Continuous or periodic addition of the carboxylic acid material along with an appropriate portion of initiator, during the course of the reaction, can be utilized to maintain the carboxylic acid below its solubility limits, while still obtaining the desired degree of total grafting.

The reaction product of the branched hydrocarbyl group precursor and the linking group precursor may be further reacted with a polar group precursor (e.g., alkylene polyamine) without isolating the reaction product from the diluent oil and without any prior treatment. In the alternative, the reaction product may be concentrated or diluted further by the addition of mineral oil of lubricating viscosity to facilitate the reaction with the polar group precursor.

The branched hydrocarbyl-substituted linking agent reaction product in solution in the synthetic oil, e.g., polymeric hydrocarbon or alkylbenzene, typically at a concentration of about 5 to 50 wt. %, preferably 10 to 30 wt. % reaction product, can be readily reacted with a polar group precursor, i.e., amine compound by heating at a temperature of from about 100° C. to 250° C., preferably from 120° to 230° C., for from about 0.5 to 10 hours, usually about 1 to about 6 hours. The heating is preferably carried out to favor formation of imides and amides. Reaction ratios can vary considerably, depending upon the reactions, amounts of excess, type of bonds formed, etc.

Typically, the polar group precursor amine compounds will be used in the range of 0.1 to 10 wt. %, preferably 0.5 to 5 wt. %, based on the weight of the hydrocarbyl-substituted linking group. The amine compound is preferably used in an amount that neutralizes the acid moieties by formation of amides, imides or salts.

Preferably the amount of amine compound used is such that there is 1 to 2 moles of amine reacted per equivalent mole of carboxylic acid. For example, with a polyisobutylene polymer of 450 number average molecular weight ($M_n$) grafted with an average of 1 maleic anhydride group per molecule, preferably about 1 to 2 molecules of amine compound is used per molecule of grafted polyisobutylene polymer.

Alternatively, as discussed above, the polar group precursor may be reacted with an aldehyde and a hydrocarbyl substituted phenol in a conventional manner to form Mannich condensates having friction increasing properties.

In a preferred aspect, the friction increasing chemical additives usable in this invention comprise those friction increasing additives prepared in accordance with copending application Ser. No. 170,470, filed on Dec. 20, 1993, and entitled "OIL SOLUBLE FRICTION INCREASING ADDITIVES FOR POWER TRANSMISSION FLUIDS (PTF-054A)", said application being incorporated herein by reference.

Compositions

A minor amount, e.g., 0.01 up to about 50 wt. %, preferably 0.1 to 10 wt. %, and more preferably 0.5 to 5 wt. %, of a combination of at least one friction reducing chemical additive and at least one other additive selected from non-friction reducing chemical additives and friction increasing chemical additives can be incorporated into a major amount of an oleaginous material, such as a lubricating oil, depending upon whether one is forming finished products or additive concentrates. The relative amounts of friction reducer additive, non-friction reducer additive and/or friction increasing additive can vary over wide limits depending in part upon the identity of the specific additives. However, the mole ratio of the friction reducing additive to non-friction reducing additive and/or friction increasing additive typically will be from about 1:99 to 99:1, and preferably from about 1:10 to 10:1.

When used in lubricating oil compositions, e.g., automatic transmission formulations, etc. the final combined concentration of the friction reducing additive, and the non-friction reducing and/or friction increasing additive typically will be in the range of from about 0.01 to 30 wt. %, e.g., 0.1 to 15 wt. %, preferably 0.5 to 10.0 wt. %, of the total composition. The lubricating oils to which the combination of additives of this invention can be added include not only hydrocarbon oils derived from petroleum, but also include synthetic lubricating oils such as esters of dicarboxylic acids; complex esters made by esterification of monocarboxylic acids, polyglycols, dicarboxylic acids and alcohols; polyolefin oils, etc.

The combination of the friction reducing additive, and the non-friction reducing and/or friction increasing additive may be utilized in a concentrate form, e.g., in a minor amount from about 0.1 wt. % up to about 50 wt. %, preferably 5 to 25 wt. %, in a major amount of oil, e.g. said synthetic lubricating oil with or without additional mineral lubricating oil.

The above oil compositions may contain other conventional additives, such as ashless dispersants, for example the reaction product of polyisobutylene succinic anhydride with polyethyleneamines of 2 to 10 nitrogens, which reaction product may be borated; antiwear agents such as zinc dialkyl dithiophosphates; viscosity index improvers such as polyisobutylene, polymethacrylates, copolymers of vinyl acetate and alkyl fumarates, copolymers of methacrylates with amino methacrylates; corrosion inhibitors; oxidation inhibitors; friction modifiers; metal detergents such as overbased calcium magnesium sulfonates, phenate sulfides, etc.

The following examples, wherein all parts or percentages are by weight unless otherwise noted, which include preferred embodiments, further illustrate the present invention.

PREPARATIVE EXAMPLES

Examples 1–3 (Preparation of Friction Reducers)

The amount of carboxylic acid (or anhydride) indicated in Table 1 was placed in a round bottom flask equipped with a stirrer, Dean Stark trap, condenser and nitrogen sparger. The acid (or anhydride) was heated to 180° C. +/−10° C. and the indicated amount of tetraethylene pentamine (TEPA) was added through a dropping funnel over a 1 to 2 hour period with a constant nitrogen sparge. Evolved water was collected in the Dean Stark Trap. After water evolution ceased, the mixture was cooled and filtered to give the desired friction reducing additive product.

TABLE 1

| EX. NO. | HYDRO-CARBYL PORTION | AMINE | RATIO ACID:AMINE | PRODUCT |
|---|---|---|---|---|
| 1 | Oleic acid 282 g (1.0 m) | TEPA 73 g (0.39 m) | 3.1:1 | 341 g, 6.6% N |
| 2 | Isostearic Acid 248 g (1.0 m) | TEPA 73 g (0.39 m) | 3.1:1 | 351 g, 6.4% N |
| 3 | OSA[1] 175 g (0.25 m) | TEPA 47.3 g (0.25 m) | 2.0:1 | 222.5 g, 4.0% N |

[1]octadecenyl succinic anhydride; octadecenyl is linear hydrocarbyl

Example 4 (Preparation of Friction Increasers)

Part A

Polyisobutenyl succinic anhydride (PIBSA) having a succinic anhydride (SA) to polyisobutylene (PIB) ratio (SA:PIB), i.e., functionality, of about 1, was prepared by gradually heating a mixture of 170 kg (280 lbs.) of PIB having a number average molecular weight (Mn) of 450 with approximately 27.7 kg (61 lbs.) of maleic anhydride to a temperature of approximately 120° C. Chlorine gas was then bubbled through the mixture at approximately 2.7 kg (6 lbs.) per hour. The reaction mixture was then heated to approximately 160°–170° C. and was maintained at that temperature until a total of approximately 22.9 kg (50.5 lbs.) of chlorine was added. The reaction mixture was then heated to approximately 220° C. and sparged with nitrogen to remove unreacted maleic anhydride. The resulting polyisobutenyl succinic anhydride had an ASTM Saponification Number (SAP) of 176, which calculates to a SA to PIB ratio of 1.14 based upon the starting PIB.

Part B

The PIBSA product was aminated by charging to a reactor approximately 36.3 kg (80 lbs.) of the PIBSA; approximately 6.0 kg (13.1 lbs.) of a commercial grade of polyethylene amine which was a mixture of polyethylene amines averaging about 5 to 7 nitrogen per molecule (PAM); 13.7 kg (30.2 lbs.) of a solvent 150 neutral oil (Exxon S150N); and 5.5 grams of a 50% mixture of a silicone-based antifoamant in a hydrocarbon solvent. The mixture was heated to 150° C., and a nitrogen sparge started to drive off water. The mixture was maintained at 150° C. for 2 hours when no further water was evolving. The product was cooled and drained from the reactor to give the final friction increasing additive product (PIBSA-PAM) having a PIBSA to PAM ratio (PIBSA:PAM) of about 2.2:1.

Examples 5–8 (Friction Tests)

Standard automatic transmission fluids (ATF's) were prepared for testing the friction characteristics of various combinations of the reaction products formed in EXAMPLES 1–4. The fluids were prepared by blending reaction products indicated in TABLE 2 into an additive concentrate, and then dissolving the concentrate into a mineral oil base fluid (Exxon FN 1391) to give the required concentration of additives. The basic test blend contained a borated ashless dispersant, a phosphite anti-wear agent, an alkylated diphenylamine antioxidant, a dimethyl silicone antifoamant and a polymethacrylate viscosity modifier. To aliquot portions of the base fluid there were added the indicated amount of the friction reducing additive product of EXAMPLE 2 and the friction increasing additive product of EXAMPLE 4 (the "CONTROL" did not contain any of said reaction products).

TABLE 2

| TEST FLUID | EX. 2 (Friction Reducer), Wt. % | EX. 4 (Friction Increaser), Wt. % |
|---|---|---|
| 5 (CONTROL) | NONE | NONE |
| 6 (COMPARATIVE) | NONE | 1.5% |
| 7 (COMPARATIVE) | 0.5% | NONE |
| 8 | 0.5% | 1.5% |

The four fluids were tested using an SAE No. 2 Friction Test Machine run to 4,000 engagement cycles using the test specified by Ford Motor Company in the MERCON specification dated May 1987, Section 3.8. The static friction coefficient achieved during the test procedure is illustrated in FIG. 1. The static friction coefficient was chosen as the coefficient to be tested since it is the most sensitive to friction modifier effects. The limits for static friction coefficient in this test are specified by Ford to be greater than 0.10, but less than 0.15.

As shown in FIG. 1, the test fluid of Example (CONTROL) gave an intermediate level for static friction coefficient of about 0.15, essentially failing the Ford limits. The level of the static friction coefficient was raised by the addition of friction increaser (COMPARATIVE) Example 6 to about 0.17. Thus COMPARATIVE Example 6 failed the Ford limits by a wide margin. The test fluid containing a friction reducer and no friction increaser (COMPARATIVE Example 7) gave a static friction coefficient of about 0.095, again failing the Ford limits. The test fluid of Example 8, which contained both a friction reducer and a friction increaser gave a static friction coefficient of about 0.13, which is exactly in the center of the limit range set by Ford. It can also be seen from FIG. 1 that the test fluid of Example 8 also was the most stable in terms of the absolute value of the static friction coefficient over the length of the run. In other words, the friction durability of the test fluid of Example 8 was superior to the friction durability of the CONTROL and the COMPARATIVE test fluids of Examples 6 and 7. Accordingly, Examples 5–8 illustrate the improvement that can be achieved by adding both a friction reducer and a friction increaser to an otherwise conventional ATF composition.

Examples 9–10 (Friction Tests)

The test procedure of Examples 5–8 was repeated, except that the SAE No. 2 Friction Test Machine was run until the fluids no longer met the Ford requirements or for 15,000 engagement cycles, whichever came first, using the test specified by Ford Motor Company in the revised MERCON specification dated Sep. 1, 1992, Section 3.8. In Examples 9 (COMPARATIVE) and 10 the friction reducer was an ethoxylated amine having the formula $C_{18}H_{37}$—O—$CH_2CH_2CH_2N(CH_2CH_2OH)_2$. In Example 9 (COMPARATIVE), there were no friction increasing nor non-friction reducing additives present in the test fluid; whereas in Example 10, a diethoxylated butyl amine was added as a non-friction reducing version of the friction reducing additive of Example 9. The amounts of the friction reducing and non-friction reducing additives are shown in TABLE 3 as follows:

TABLE 3

| TEST FLUID | FRICTION REDUCER | NON-FRICTION REDUCER |
|---|---|---|
| 9 (COMPARATIVE) | 0.16% | NONE |
| 10 | 0.32% | 0.10% |

Figure 2:
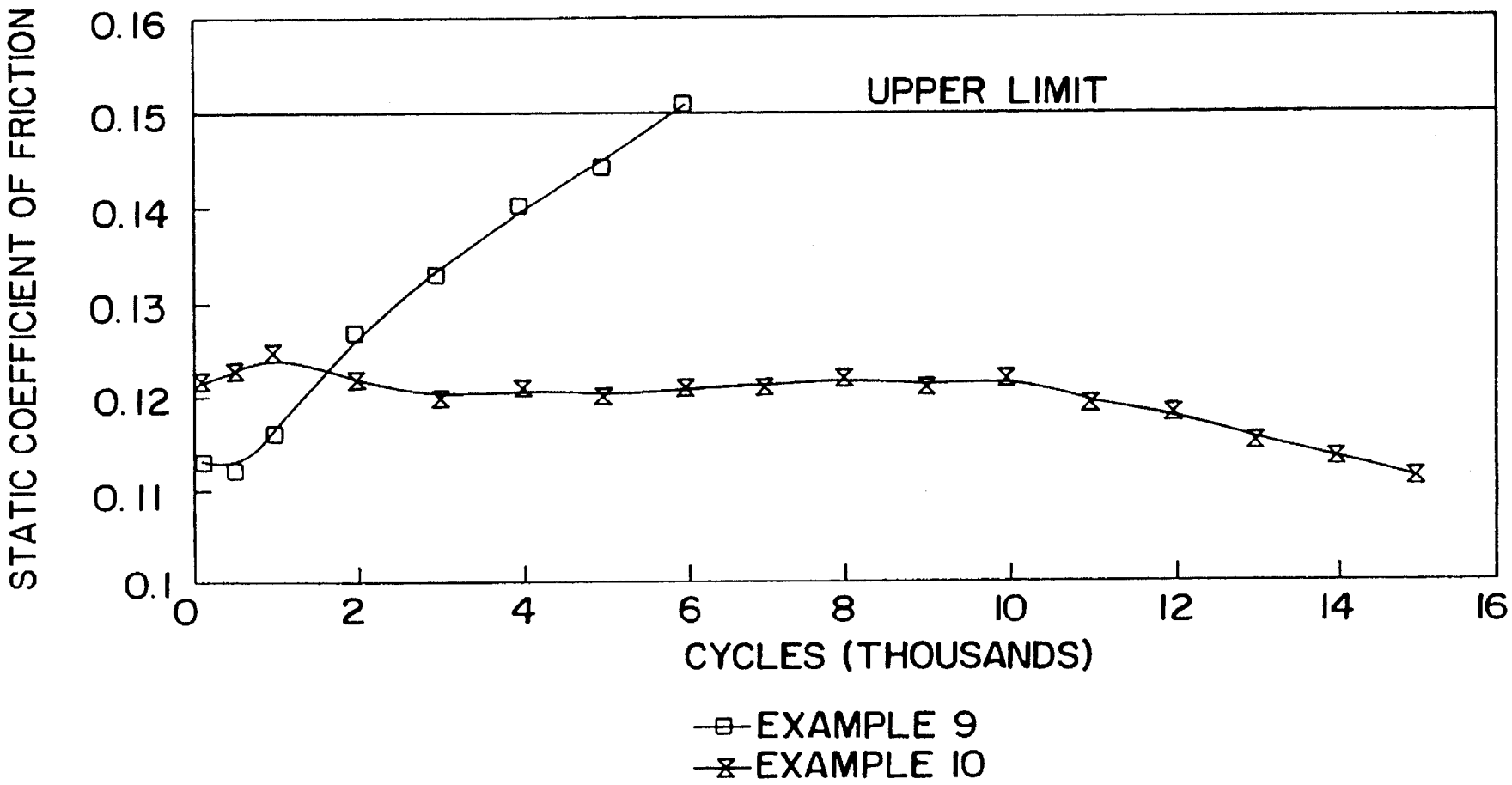
FIG. 2 is a graph similar to that of FIG. 1, except that it illustrates a test run to 15,000 engagement cycles.

The static friction coefficient achieved during the test runs is illustrated in FIG. 2. As shown in FIG. 2, the test fluid which contained only a friction reducing additive (COMPARATIVE Example 9) met the Ford requirements for only about 6,000 engagement cycles; whereas the test fluid containing a combination of a friction reducing additive and a non-friction reducing additive (Example 10) was well within Ford's specified range for static friction coefficient even after 15,000 engagement cycles. Clearly, the test fluid of Example 10 was characterized by a very much improved friction durability relative to the fluid of COMPARATIVE Example 9.

What is claimed is:

1. A method of improving the friction durability of an oleaginous composition, which comprises:

adding to a major portion of an oil of lubricating viscosity a friction durability improving effective amount of an oil soluble combination of chemical additives comprising (a) a first chemical additive comprising a polar head group and a friction reducing substituent group, wherein said polar head group is an alkoxylated amine, and (b) at least one other chemical additive having the same polar head group as said first chemical additive but having a substituent group selected from non-friction reducing substituent groups and friction increasing substituent groups.

2. The method of claim 1, wherein said friction reducing substituent group comprises a substantially linear hydrocarbyl group having at least 10 carbon atoms.

3. The method of claim 1, wherein said non-friction reducing substituent group comprises a hydrocarbyl group having fewer than 10 carbon atoms.

4. The method of claim 1, wherein said friction increasing substituent group comprises a branched chain hydrocarbyl group containing from about 12 to about 50 total carbon atoms.

5. The method of claim 4, wherein said branched chain hydrocarbyl group has the formula

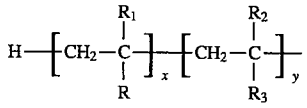

wherein R is a $C_1$ to $C_{12}$ hydrocarbyl group, optionally substituted with non-interfering heteroatoms; $R_1$, $R_2$ and $R_3$, independently, are H or $C_1$ to $C_{12}$ hydrocarbyl, optionally substituted with non-interfering heteroatoms; x is 1 to 17; and y is 0 to 10.

6. The method of claim 1, wherein said alkoxylated amine is —$N(CH_2CH_2OH)_2$.

7. The method of claim 1, wherein said chemical additive having a friction increasing substituent group comprises an oil soluble friction increasing reaction product comprising (i) an oil soluble substituted or unsubstituted, saturated or unsaturated, branched hydrocarbyl group containing from about 12 to about 50 total carbon atoms, (ii) a linking group, and (iii) a nitrogen-containing polar group; said polar group containing at least one atom selected from the group consisting of boron, oxygen and sulfur atoms, and being linked to said hydrocarbyl group through said linking group.

8. An oleaginous composition comprising a major amount of an oil of lubricating viscosity and an amount effective for controlling the friction coefficients and the friction durability of said composition comprising (a) a first chemical additive comprising a polar head group and a friction reducing substituent group, wherein said polar head group is an alkoxylated amine, and (b) at least one other chemical additive having the same polar head group as said first chemical additive but having a substituent group selected from non-friction reducing substituent groups and friction increasing substituent groups.

9. An additive concentrate for improving the friction durability of an oleaginous composition which comprises (a) a first chemical additive comprising a polar head group and a friction reducing substituent group, wherein said polar head group is an alkoxylated amine, and (b) at least one other chemical additive having the same polar head group as said first chemical additive but having a substituent group selected from non-friction reducing substituent groups and friction increasing substituent groups.

* * * * *